US006971214B2

(12) United States Patent
Ringel

(10) Patent No.: US 6,971,214 B2
(45) Date of Patent: Dec. 6, 2005

(54) WORK CELL

(75) Inventor: David W. Ringel, Monroe, MI (US)

(73) Assignee: Hollingsworth Logistics Group, Dearborn, MI (US)

( * ) Notice: Subject to any disclaimer, the term of this patent is extended or adjusted under 35 U.S.C. 154(b) by 0 days.

(21) Appl. No.: 10/712,068

(22) Filed: Nov. 13, 2003

(65) Prior Publication Data

US 2004/0093832 A1 May 20, 2004

Related U.S. Application Data

(60) Provisional application No. 60/425,957, filed on Nov. 13, 2002, provisional application No. 60/425,913, filed on Nov. 13, 2002.

(51) Int. Cl.[7] ..... B65B 61/00; B65B 67/00
(52) U.S. Cl. ..... 53/138.2; 53/284.5; 53/390
(58) Field of Search ..... 53/136.1, 138.2, 53/284.5, 390, 391, 416, 569, 392; 209/703; 227/154; 248/346.5; 108/55.3

(56) References Cited

U.S. PATENT DOCUMENTS 1,439,825 A * 12/1922 Kuhn et al. ..... 209/703
1,824,979 A * 9/1931 Black ..... 53/390
2,644,579 A * 7/1953 Paxton ..... 209/546
3,126,685 A * 3/1964 Paxton ..... 53/138.2
3,161,004 A * 12/1964 Muzinich ..... 53/391
3,477,349 A * 11/1969 Berney ..... 53/138.2
3,579,962 A * 5/1971 Mitten ..... 53/390
3,688,466 A * 9/1972 Geyer ..... 53/138.2
3,830,036 A * 8/1974 Harkness et al. ..... 53/391
4,026,453 A * 5/1977 Davison et al. ..... 227/109
4,033,090 A * 7/1977 Carlson ..... 53/391
4,333,300 A * 6/1982 Russell ..... 53/569
4,522,016 A * 6/1985 DiRico ..... 53/390
4,662,150 A * 5/1987 Johnson et al. ..... 53/390
4,909,697 A * 3/1990 Bernard et al. ..... 414/331.04
5,218,812 A * 6/1993 Ventura et al. ..... 53/391
5,544,468 A * 8/1996 Harrison et al. ..... 53/390
5,637,071 A * 6/1997 Simmons et al. ..... 53/390
5,957,307 A * 9/1999 Schulz ..... 209/630
6,094,885 A * 8/2000 Ranhotra ..... 53/390
6,134,862 A * 10/2000 Francois ..... 53/390

* cited by examiner

*Primary Examiner*—John Sipos
(74) *Attorney, Agent, or Firm*—Harness, Dickey & Pierce P.L.C.

(57) ABSTRACT

A work cell has an inbound portion and an outbound portion. The inbound and outbound portions are angled relative to each other, at approximately 135°. The inbound portion is comprised of an inbound cradle to facilitate the loading of items within containers. The outbound portion has a processing region comprised of a fastening device to secure the containers in a closed condition. The fastening device has at least one alignment device to facilitate the alignment of the containers with the fastening device. The fastening and alignment devices may be positioned to accommodate containers of different sizes. The outbound portion also has a labeling region with an outbound cradle to facilitate the application of labels to an exterior of the containers. The work cell is equipped with numerous ergonomic devices facilitating the storage and placement of items useful in the operation of the work cell.

30 Claims, 3 Drawing Sheets

FIG. 5.
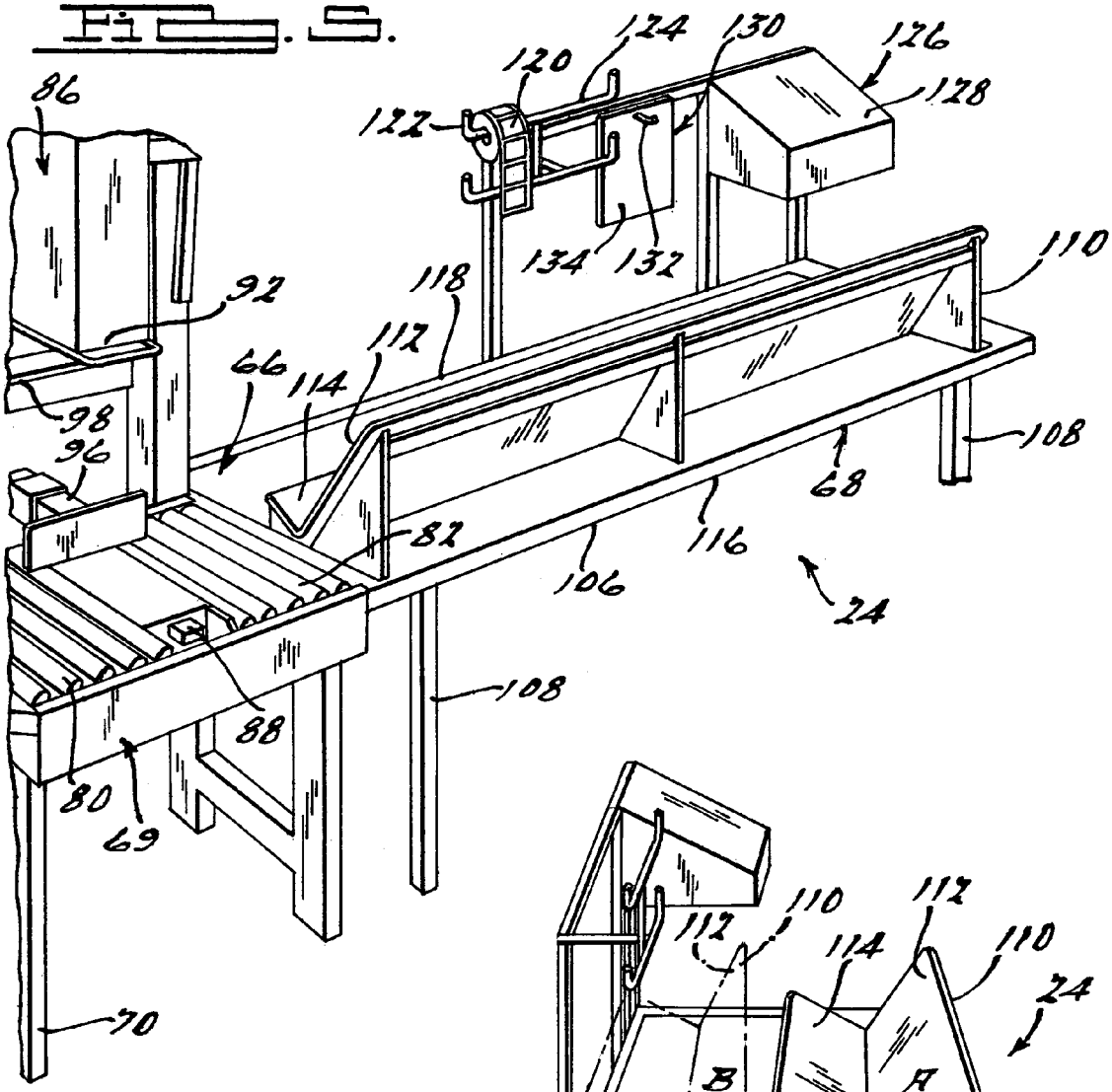
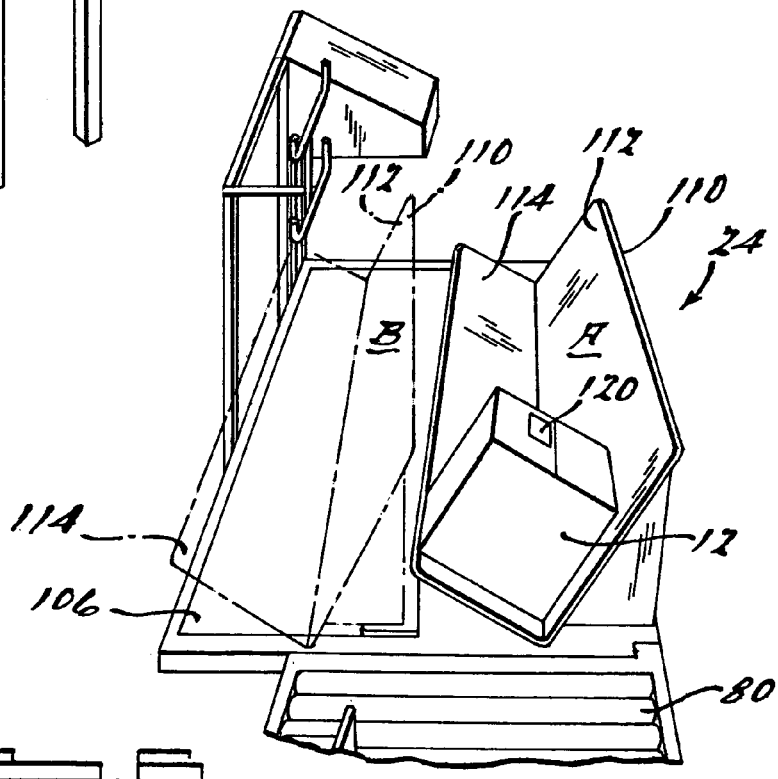
FIG. 6.

WORK CELL

CROSS-REFERENCE TO RELATED APPLICATIONS

This application claims the benefit of U.S. Provisional Application Nos. 60/425,957 and 60/425,913, both filed on Nov. 13, 2002. The disclosures of the above applications are incorporated herein by reference.

FIELD OF THE INVENTION

The present invention relates to a work cell. In particular, the present invention relates to a work cell having an inbound portion that is angled at approximately 135° to an outbound portion. The work cell is used to form, load, fasten, and label one or more suitable packaging containers.

BACKGROUND OF THE INVENTION

Numerous work cells currently exist and perform adequately for their intended purpose. However, conventional work cells are subject to improvement. Specifically, conventional work cells often occupy a large amount of floor space, thus limiting the amount of space available for additional machinery and/or storage. Conventional work cells also fail to provide hands free operation, thus making operation more difficult and more time consuming. Additionally, conventional work cells are not accommodating or ergonomic as they fail to provide suitable mounting devices and/or locations for various other materials and devices needed for the operation of the work cell and fail to position packaging cartons so as to permit easy and rapid processing by the operator. Further, conventional work cells are unable to readily transition between processing packaging containers of different sizes. Finally, conventional work cells do not provide for fastening devices that permit simultaneous closure of a packaging carton at multiple different points or provide the operator with free access to handle the packaging carton as it passes through the stapling device.

Therefore, a need exists in the art for an improved work cell. Specifically, there is a need for a work cell that occupies a minimum amount of floor space, enables hands free operation, provides a more ergonomic work environment, facilitates the transition from processing containers of one size to processing containers of another size, improves the flow of work through the work cell, and includes an improved stapling device that permits simultaneous closure of a packaging carton at multiple different points and provides the operator with open access to the packaging carton as it passes through the stapling device. As described below, the current invention fulfills these needs and others.

SUMMARY OF THE INVENTION

The current invention provides for a work cell with an inbound portion and an outbound portion. The inbound portion and outbound portion are situated at an angle relative to each other, the angle typically being approximately 135°. The 135° angle frees valuable floor space, thus enabling the placement of additional machinery in the same amount of space. The inbound portion includes an inbound cradle that tilts a packaging container towards the operator. The tilting frees both of the operator's hands to load the container and prevents the operator from having to reach over and into the container during loading. The outbound portion includes a fastening device to secure the packaging containers in a closed condition. A labeling portion enables the application of a label to the packaging container. The fastening device may be easily configured to process containers of different sizes. The work cell is further comprised of numerous mounting devices, label holders, and compartments for the storage and ergonomic placement of various items used in the operation of the work cell.

The fastening device has a first head and a second head. The first and second heads simultaneously apply fasteners to a suitable packaging container. The first and second heads are orientated to permit the uninterrupted flow of cartons through the work cell. Further, the positioning of the first and second heads allows the work cell to process cartons of an infinite length. Application of the fasteners, via the first head and the second head, may be effectuated through the use of a foot pedal. This enables the operator to position the packaging container beneath the first and second heads with two hands. The position of the first head and the second head may be altered through the actuation of a single button. This provides a fastening table that is capable of accommodating packaging containers of different sizes and styles. The fastening table has a lower guide rail assembly and an upper guide rail assembly. The lower guide rail assembly and upper guide rail assembly aid in the positioning of the packaging container between the first head and the second head. The positions of the lower guide rail assembly and upper guide rail assembly may be altered by the user according to the size and shape of the particular packaging container used.

Further areas of applicability of the present invention will become apparent from the following detailed description. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 5 is a perspective side view of the outbound portion of FIG. 1; and FIG. 6 is a side view of an outbound cradle of the outbound portion of FIG. 1 with the cradle shown illustrated in a forward position and a rear position (in phantom).

DETAILED DESCRIPTION OF THE PREFERRED EMBODIMENTS

The following description of the preferred embodiment is merely exemplary in nature and is in no way intended to limit the invention, its application, or uses.

Figure 1:
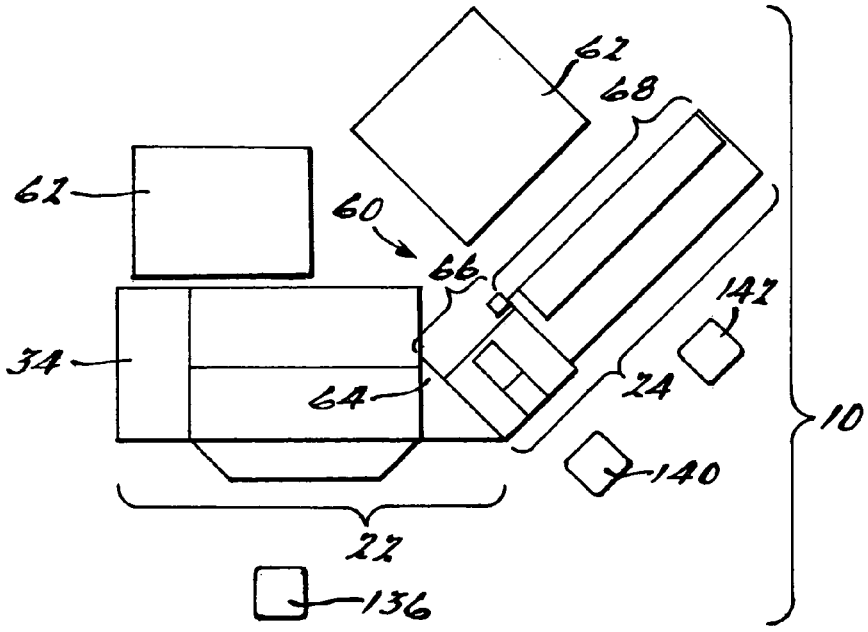
FIG. 1 is a schematic plan view of a work cell of the present invention illustrating the angled orientation of an inbound portion to an outbound portion.

As seen in FIG. 1, a work cell 10 in accordance with a preferred embodiment of the present invention is shown. Work cell 10 is configured to package items within a suitable packaging container, illustrated in FIG. 2 as packaging carton 12. Typically, packaging carton 12 has a top portion 14, a bottom portion 16, side portions 18, and an interior 20 when fully formed. Carton 12 may take the form of numerous different styles such as, but not limited to, full overlap cartons, partial overlap cartons, and regular slotted cartons. Carton 12 may be of various sizes but is typically within the range of 5"×1"×5" up to an infinite length×18"×28". However, it must be noted that work cell 10 may be configured to process a variety of different types of packaging containers. Further, it must be realized that work cell 10 may be configured to carry out a variety of different operations in addition to the packaging operations described below.

The work cell 10 generally comprises an inbound portion 22 and an outbound portion 24. The inbound portion 22 and outbound portion 24 are placed at an angle relative to each other. Typically, the inbound portion 22 is set at an angle that is approximately 135° relative to the outbound portion 24. Inbound portion 22 and outbound portion 24 may be separate, but linked portions, or may be one single portion.

Figure 2:
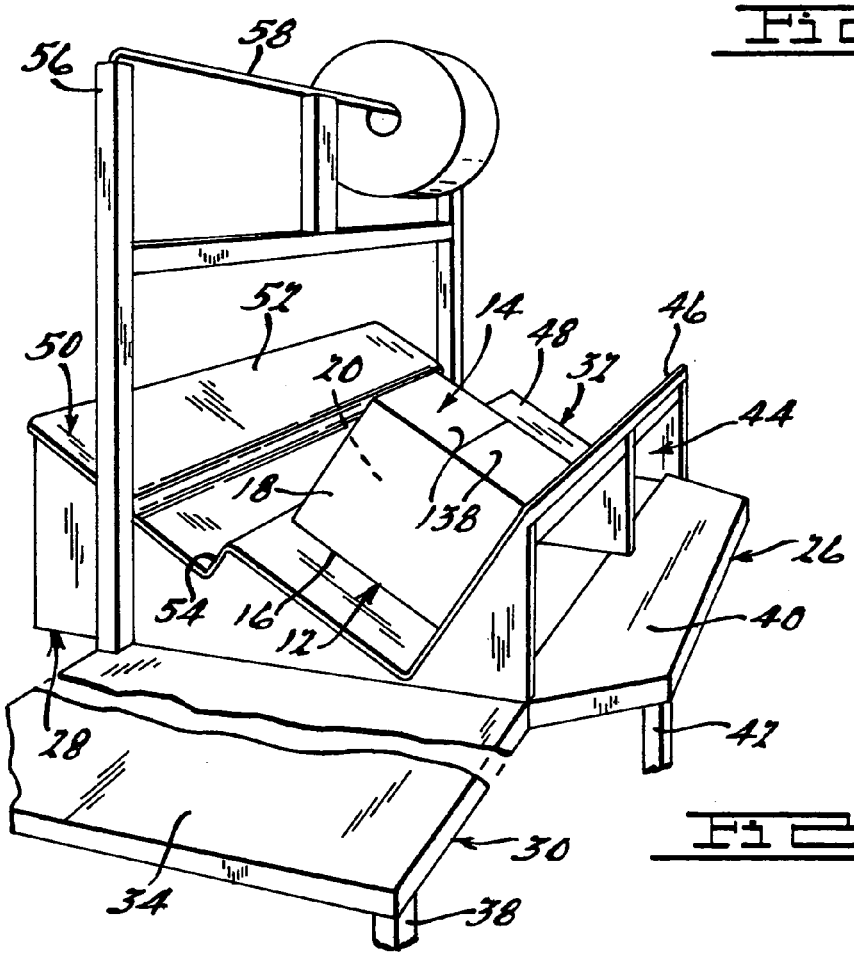
FIG. 2 is a perspective side view of the inbound portion of FIG. 1.

With continued reference to FIG. 1 and additional reference to FIG. 2, inbound portion 22 will now be described in detail. Inbound portion 22 may be any suitable length but is typically approximately eight feet in length. Inbound portion 22 is generally comprised of a front side 26, a rear side 28, a first end 30 and a second end 32.

First end 30 typically includes an inbound platform 34. Inbound platform 34 may be of any suitable shape or size but is typically flat and either square or rectangular. Inbound platform 34 may be used to support any object of a suitable weight and a suitable size. Typically, inbound platform 34 is used to support a plurality of cartons 12 before the cartons 12 are folded and processed. Inbound platform 34 contains a plurality of legs 38, or any other suitable support device, so as to support inbound platform 34.

Inbound portion 22 also includes an elongated ledge 40. Elongated ledge 40 may be of any suitable shape or size but is typically rectangular. Elongated ledge 40 typically extends along the front side 26 for a majority of the length of inbound portion 22. The elongated ledge 40 may be used to provide support for items used in the operation of work cell 10, such as gloves, parts, or any other item. Elongated ledge 40 is typically supported by legs 42.

Inbound portion 22 further includes a front cradle 44. The front cradle 44 is typically supported by legs (not shown) and elongated ledge 40. Front cradle 44 is generally comprised of a first angled portion 46 and a second angled portion 48. The first and second angled portions 46, 48 terminate at approximately 90° to each other. The first angled portion 46 typically extends at an angle towards front side 26 while the second angled portion 48 typically extends at an angle toward rear side 28. The actual angles of angled portions 46, 48 may be of any suitable angle so that when carton 12 is seated within the front cradle 44, the carton 12 is tilted toward front side 26.

Use of front cradle 44 to support carton 12 is advantageous as it frees the hands of the operator. This enables the operator to use both hands to load carton 12 quickly and easily. Front cradle 44 further eases loading of carton 12 by tilting carton 12 toward the operator. This enables the operator to easily place the items to be packaged within interior 20 of carton 12 without being subject to undue strain caused by excessive reaching over and into carton 12. Further, use of front cradle 44 is advantageous as front cradle 44 holds bottom portion 16 of carton 12 closed even before the bottom portion 16 has been fixedly secured.

Inbound portion 22 also includes a rear cradle 50. Rear cradle 50 is positioned behind front cradle 44 towards the rear side 28 of work cell 10. Rear cradle 50 may be unitary with the front cradle 44 or may be separate from front cradle 44 and either secured to or adjacent to front cradle 44. Rear cradle 50 has a horizontal support 52 and a vertical support 54. The horizontal support 52 and vertical support 54 meet at approximately a 90° angle to each other with horizontal portion 52 angled away from front side 26. Rear cradle 50 provides support for items of use for the operation of work cell 10, making such items readily accessible to the operator. Items that may be supported by rear cradle 50 include, but are not limited to, small sub bags, instruction sheets, work gloves, parts, etc.

Inbound portion 22 also includes a mounting bracket 56. The mounting bracket 56 may be supported in a variety of different ways, such as by being free standing or mounted to rear cradle 50. The mounting device 56 has one or more roll holders 58 to support a wide variety of items useful in the operation of work cell 10, such as, but not limited to, bags and bubble wrap.

The 135° angle between the inbound portion 22 and the outbound portion 24 provides work cell 10 with an overall configuration that is smaller than work cells without such an angle, thus freeing valuable floor space for use by additional items or devices, such as additional work cells 10. Further, the 135° configuration provides an open area 60 behind the work cell 10 suitable for the placement of devices or items useful in the operation of work cell 10, such as dunnage machines 62 (FIG. 1). Locating such devices or items in open area 60 is advantageous as the operator is able to easily access the devices or items without disrupting operation of work cell 10. Still further, the 135° angle permits the uninterrupted flow of cartons 12 through the work cell 10 and allows the work cell 10 to process cartons 12 of an infinite length.

Located at second end 32, of inbound portion 22 is stand 64 (FIG. 1). Stand 64 provides a space for holding one or more cartons 12 before the cartons 12 are transferred from inbound portion 22. The stand 64 may be of any suitable shape or size but is typically angled to aid in the positioning of inbound portion 22 at approximately 135° to outbound portion 24. Stand 64 may be supported by legs (not shown) or may be integral with inbound portion 22 or outbound portion 24.

Outbound portion 24 may either be integral with the inbound portion 22, secured to inbound portion 22, or positioned such that it closely abuts inbound portion 22. With reference to FIG. 1, outbound portion 24 is generally comprised of any suitable processing region, typically in the form of a fastening region 66, and a labeling region 68. Outbound portion 24 may be of any suitable length but is typically approximately eight feet in length.

Figure 3:
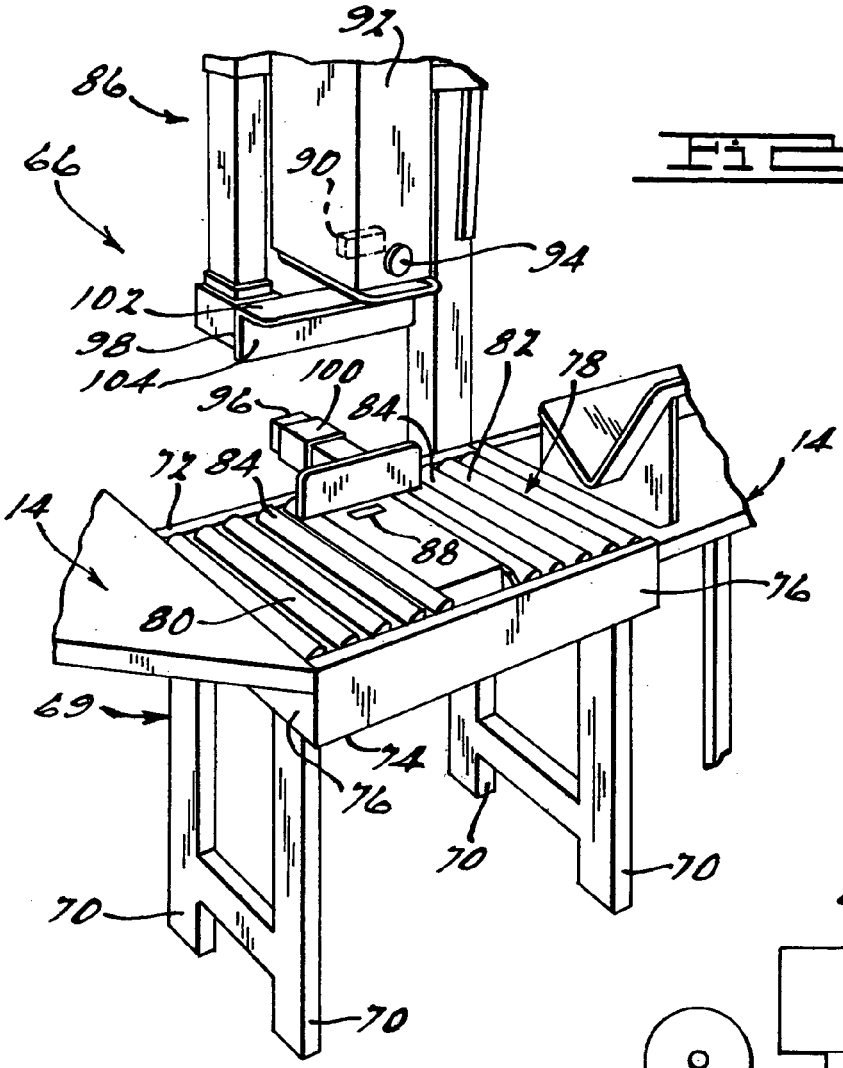
FIG. 3 is a perspective side view of a fastening region of FIG. 1.

With reference to FIG. 3, fastening region 66 includes a fastening table 69. The fastening table 69 may be supported in any suitable manner but is typically supported by a plurality of legs 70. The fastening table 69 may be configured as a stand alone device or the fastening table 69 may be incorporated within any other type of suitable machine or device, such as the work cell 10.

The fastening table 69 is generally comprised of a surface portion 72, an underside 74, and side portions 76. The surface portion 72 contains a transport device 78. The transport device 78 is comprised of inbound portion 80 and outbound portion 82. Inbound portion 80 and outbound portion 82 typically include rollers 84. The fastening table 69 is capable of processing a wide variety of suitable packaging containers, such as carton 12.

Figure 4:
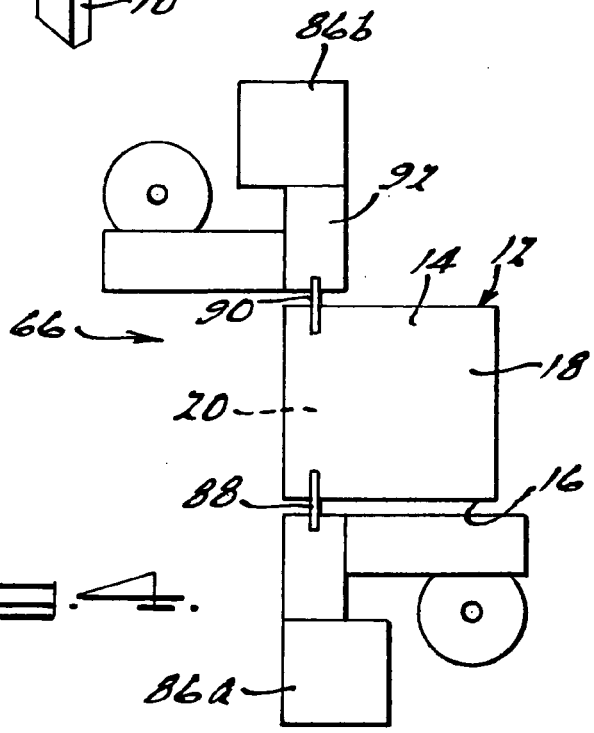
FIG. 4 is a side view illustrating the orientation of the stapling heads of a stapling device of FIG. 1 in relation to each other and to a packaging container.

With continued reference to FIG. 3 and additional reference to FIG. 4, fastening table 69 is further equipped with a fastening device 86. The fastening device 86 may take the form of any suitable fastening device that is capable of simultaneously fastening two different sides of carton 12. Typically, fastening device 86 takes the form of a stapler having a lower stapling head 88 and an upper stapling head 90. The lower head 88 is typically located within surface 72 between inbound portion 80 and outbound portion 82. Upper head 90 is typically mounted on a mounting bracket 92. Mounting bracket 92 may be mounted to fastening table 69 or may be independent of fastening table 69, such as being positioned to freely stand on a shop floor. The presence of inbound portion 80 and outbound portion 82 is advantageous as portions 80, 82 enable carton 12 to be easily transferred to and from fastening device 86.

The position of upper head 90 may be varied so as to accommodate cartons 12 of different shapes and sizes, however, upper head 90 remains in substantial vertical alignment with lower head 88. The position of upper head 90 is varied through movement of mounting bracket 92. The position of mounting bracket 92 may be altered manually or automatically. Automatic movement of mounting bracket 92 may be achieved by configuring bracket 92 with a suitable positioning device, such as a hydraulic positioning device (not specifically shown). The hydraulic positioning device may be operated in numerous different ways but is typically operated using a simple and easy to use one-touch interface, such as push-button 94. One-touch actuation of push-button 94 activates the positioning device and causes the positioning device to alter the position of mounting bracket 92 and the associated upper stapling head 90. Using button 94, the positioning device, and associated upper head 90, may be moved up to accommodate large cartons 12 or down to accommodate small cartons 12.

As seen in FIG. 4, while lower head 88 and upper head 90 remain in substantial vertical alignment, the actual fastening devices 86*a* and 86*b* associated with each head 88 and 90 are of opposing orientations. By positioning the fastening devices 86*a* and 86*b* in the orientation seen in FIG. 4, the operator is able to gain access to the top portion 14 of carton 12 and is better able to position and maneuver carton 12.

With reference to FIG. 3, typically, fastening table 69 is further equipped with two guide rail assemblies, lower guide rail assembly 96 and upper guide rail assembly 98. The guide rail assemblies 96, 98 facilitate alignment of carton 12 with stapler heads 88, 90. Lower guide rail assembly 96 is typically mounted upon mounting bracket 100 and positioned in close proximity to lower stapling head 88. As illustrated, lower guide rail assembly 96 takes the shape of a rectangular slab, however, it must be noted that lower guide rail assembly 96 may be of any shape or size so as to align carton 12 above lower head 88 and below upper head 90. The position of lower guide rail assembly 96 may be altered by the operator according to the particular size of carton 12 and the portion of carton 12 that the operator wishes to fasten.

Upper guide rail assembly 98 is typically positioned upon mounting bracket 92 within close proximity to upper stapling head 90. As illustrated in FIG. 3, upper guide rail assembly 98 has a horizontal portion 102 and a vertical portion 104. Both portions 102, 104 abut carton 12 on two different sides. Horizontal portion 102 and vertical portion 104 meet at approximately a right angle to each other and both portions 102, 104 are generally of a rectangular shape. However, it must be noted that upper guide rail assembly 98 may be of any shape or size so as to align carton 12 below upper head 90 and above lower head 88. The position of upper guide rail assembly 98 may be altered by the operator manually or through the movement of mounting bracket 92 in response to actuation of push-button 94.

As illustrated in FIG. 3, the heads 88 and 90 are vertically aligned in close proximity with guide rail assemblies 96 and 98. Positioning heads 88 and 90 in this manner allows the fastening table 69 to process cartons of an infinite length. Specifically, the position of heads 88 and 90 allows cartons 12 of an infinite length to pass through fastening table 12 without being obstructed by components of either the inbound portion 22 or the outbound portion 24.

After being securely closed, the carton 12 is typically transferred to labeling region 68 for labeling (FIGS. 1, 5 and 6). The labeling region 68 is generally comprised of an elongated table 106. Elongated table 106 may be of any size or shape but is typically rectangular. The table 106 is typically supported by a suitable support device such as legs 108. The elongated table 106 is typically separate but secured to fastening region 66. However, elongated table 106 may also be integral with fastening region 66 or separate but nearly abutting fastening region 66.

Disposed atop elongated table 106 is an outbound cradle 110. Outbound cradle 110 extends approximately the entire length of elongated table 106. Outbound cradle 110 is generally comprised of a first angled portion 112 and a second angled portion 114. The first and second angled portions 112, 114 terminate at approximately 90° angles to each other. The first angled portion 112 typically extends at an angle towards a front side 116 of outbound portion 24. The second angled portion 114 typically extends at an angle toward a rear side 118. Like inbound cradle 44, the actual angles of outbound angled portions 112, 114 may be any suitable angle so as to tilt carton 12 toward front side 116 of outbound portion 24.

With reference to FIG. 6, outbound cradle 88 is slidably received by elongated table 106 such that outbound cradle 110 may be selectively positioned between a forward position A and a back position B. The position of the outbound cradle 110 depends upon the size of the particular carton 12 being used with work cell 10. For example, if the carton 12 used is of a generally smaller size, then the cradle 110 will typically be placed in forward position A. In contrast, if the carton 12 is of a generally larger size, then cradle 110 will typically be placed in back position B.

When placed in forward position A the cradle 110 provides a receptacle for carton 12. Placing carton 12 within outbound cradle 110 is desirable as outbound cradle 110 provides a secure seat for carton 12 so as to prevent the carton 12 from falling from work cell 10 and being damaged. Further, placement of carton 12 within outbound cradle 110 aligns the carton 12 and positions carton 12 so that it is angled toward the operator to facilitate the application of a suitable identifier, such as label 120. However, if the particular carton 12 used is too large to fit within outbound cradle 110, then cradle 110 can not be used.

When the cradle 110 is placed in back position B the outbound portion 24 is able to process a carton 12 of a larger size as passage of a larger carton 12 through fastening region 66 is not impeded by outbound cradle 110. Thus, a large carton 12 may freely pass through fastening region 66 and may be freely transferred to labeling portion 68 when outbound cradle 110 is in position B.

Typically, outbound portion 24 further has a series of mounting and storage devices for items used by the operator for the operation of work cell 10. Specifically, outbound portion 24 is equipped with a label holder 122. Label holder 122 may take the form of any suitable device for holding labels 120 but typically takes the form of one or more rods 124. The rods 124 are typically configured so that at least one rod 124 extends horizontally to receive labels 120 arranged on a spool.

Outbound portion 24 further has a compartment 126 to hold items or documents associated with the operation of the work cell 10, such as work orders, tools, parts, and product specifications. The compartment 126 may take the form of any suitable containment device but typically as a plurality of containers (not specifically shown) and an upper surface 128 angled toward front side 116 to provide a surface suitable for writing. Compartment 126 may be supported in numerous different ways but is typically secured to elongated table 106.

Outbound portion 24 further has a sample photograph holder 130. The photograph holder 130 typically extends from elongated table 106 and has a support device 132 and support board 134. Using support device 132, the photograph holder 130 is capable of supporting various documents or items useful in the operation of work cell 10, such as a sample photograph.

With reference to FIGS. 1 through 6, the operation of work cell 10 will now be described in detail. It must be noted that work cell 10 may be operated in numerous different ways and that the operation, as described below, is merely an exemplary description. It must be noted that the operations described below need not be performed in the sequence described and that select operations may be performed alone or in combination with any of the other operations. Further, the invention is not limited to the use of carton 12 as any suitable packaging device may be used. Finally, while the below description focuses on the use of a single carton 12, it must be realized that work cell 10 is capable of processing multiple cartons 12 simultaneously.

Inbound portion 22 is generally used to form and load cartons 12 with the particular items to be packaged. The operator may generally perform all operations of inbound portion 22 while standing in close proximity to operating position 136 (FIG. 1). Standing at position 136, the operator selects a carton 12 typically from a stack of unformed cartons 12 located upon platform 34. Prior to being placed upon front cradle 44, the unformed cartons 12 are manually formed by the operator. Each formed carton 12 is typically placed on the cradle 48 so that flaps 138 of top portion 14 remain open while flaps (not shown) of bottom portion 16 are folded in a closed position to prevent the items placed within the container from falling out of the container.

With carton 12 seated within front cradle 44 there is no need for the operator to manually support carton 12. This leaves the operator's hands free to easily and quickly load the carton 12. At inbound portion 22, the operator also has access to dunnage machine 62 to add dunnage to the carton 12, as needed. Due to the 135° angle of the inbound portion 22 relative to the outbound portion 24, the dunnage machine 62 may be located behind the work cell 10 without occupying floor space that may be used by other equipment. Finally, due to the presence of elongated ledge 40, rear cradle 50, and mounting bracket 56, work cell 10 provides the operator with ready access to a wide variety of different items, such as work gloves, instruction sheets, and spare parts, needed to perform his/her duties without leaving operating position 136.

After carton 12 is loaded with the items to be packaged and/or dunnage, the carton 12 may be transferred directly to fastening region 66 to be securely closed. Transfer of carton 12 to stapler heads 88, 90 is aided by transfer device 78. Use of transfer device 78 is preferred as rollers 84 enable carton 12 to be easily moved without much effort being exerted by the operator.

To properly align the carton 12 with lower head 88 and upper head 90, the guide rail assemblies 96 and 98 and the upper head 90 are adjusted according to the particular size of the carton 12. This adjustment may be performed either manually or automatically through actuation of push-button 94. The carton 12 is next positioned against the guide rail assemblies 96 and 98 and the heads 88 and 90 are activated by the operator using any suitable device, such as a foot pedal (not shown). Activation of the heads 88 and 90 simultaneously injects at least two suitable fasteners, such as staples (not shown), within the surfaces of the carton 12 abutting the heads 88 and 90, typically top portion 14 and bottom portion 16. Once the carton 12 is sealed, it is transported from the heads 88 and 90 and then removed from the fastening table 69.

As seen in FIG. 4, the use of fastening table 69 is advantageous as fastening table 69 allows the operator to use two hands to position carton 12 between heads 88 and 90. The ability of the operator to use two hands allows the operator to maneuver and position carton 12 more easily and safely than if the operator was only able to use a single hand.

The carton 12 is typically transferred from the fastening table 69 to the elongated table 106 of the outbound portion 24. However, carton 12 may also be removed from work cell 10 if further processing by work cell 10 is not desired.

As described above, elongated table 106 is equipped with an outbound cradle 110 to receive cartons 12. If a large sized carton 12 is used, the cradle is typically positioned in back position B to enable the elongated table 106 to receive the large carton 12 as the outbound cradle 110 is not sized to receive oversize cartons 12. However, if carton 12 is of a size suitable for receipt by outbound cradle 110, the cradle 110 is positioned in forward position A. With the carton 12 seated within outbound cradle 110, a label 120 may then be easily placed upon the carton 12.

Carton 12 is typically labeled manually by the operator. Specifically, the operator typically selects the proper label from a series of labels held by label holder 122 and places the label upon carton 12 at the appropriate position. After carton 12 is properly labeled, the carton 12 is removed from the work cell 10 for further processing or shipment.

Outbound portion 24 is typically operated by an operator standing at operating position 142. The compact nature and ergonomic design of outbound portion 24 is evidenced by the fact that the operator is able to operate outbound portion 24, and is provided access to all the necessary operating materials and devices, by standing nearly stationary at operating position 142.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A work cell for packaging materials within a container comprising:

an inbound portion having:

a first cradle positioned at an acute angle relative to a horizontal plane of said inbound portion and toward an operating side of the work cell; and a second cradle positioned at an acute angle relative to a horizontal plane of said inbound portion and toward an operating side of the work cell;

said first cradle is integral with said second cradle; and an outbound portion for supporting a packaging container;

wherein said inbound portion and said outbound portion are positioned in at least a nearly abutting relationship, said inbound portion and said outbound portion being positioned at an obtuse angle relative to each other to provide the work cell with an ergonomic, space-saving configuration;

wherein said first cradle and said second cradle are orientated to support the container such that the container is rotated toward the operating side of the work cell; and a fastening device between said inbound and outbound portions.

2. The work cell of claim 1, wherein said inbound portion is positioned at an angle of approximately 135° relative to said outbound portion.

3. The work cell of claim 1, wherein said first cradle is above said second cradle.

4. The work cell of claim 1, wherein said first and second cradles position a top portion of the container towards a front side of said work cell.

5. The work cell of claim 1, wherein said outbound portion includes an elongated table having an outbound cradle.

6. The work cell of claim 5, wherein said outbound cradle may be positioned in a forward position and a rear position.

7. The work cell of claim 1, further comprising a fastening device having:

a first head for applying at least one fastener to the container; and a second head for applying at least one fastener to the container;

wherein the orientation between said first head and said second head may be altered according to the size and type of the container used.

8. The work cell of claim 7, wherein the container is transferred to and from said fastening device by a transfer device.

9. The work cell of claim 7, wherein said fastening device includes at least one alignment device for properly positioning the container in relation to said fastening device.

10. The work cell of claim 1, further comprising a mounting device for supporting materials for use in the operation of the work cell.

11. The work cell of claim 1, further comprising a label holder for supporting labels to be placed upon the container.

12. The work cell of claim 1, further comprising a compartment for storing materials used in the operation of said work cell.

13. The work cell of claim 7, wherein said first head and said second head apply said fastener to said container simultaneously.

14. The fastening device of claim 7, wherein said first head is positioned approximate to a first alignment device and said second head is positioned approximate to a second alignment device.

15. A work cell for packaging materials within a container comprising:

an inbound portion for loading items within the container; and an outbound portion having a processing region and an outbound region facilitating the application of identification labels to the container;

said outbound portion including an outbound cradle positioned at an acute angle relative to a horizontal plane of said outbound portion and toward an operating side of the work cell, said outbound cradle movable between a forward position and a rear position;

wherein said outbound cradle is orientated to support the container such that the container is rotated toward the operating side of the work cell; and wherein said inbound portion and said outbound portion are positioned in at least a nearly abutting relationship, said inbound portion and said outbound portion being positioned at an obtuse angle relative to each other; and a fastening device between said inbound and outbound portions.

16. The work cell of claim 15, wherein said inbound portion and said outbound portion are positioned between about 90° and about 135° relative to each other.

17. The work cell of claim 15, wherein said inbound portion further comprises a front cradle for positioning a top portion of the container towards a front side of said work cell.

18. The work cell of claim 15, wherein said inbound portion further comprises a rear cradle for supporting items of use in the operation of said work cell.

19. The work cell of claim 15, wherein said outbound portion includes an elongated table.

20. The work cell of claim 15, wherein said packaging containers are transferred to and from said processing region by a transfer device.

21. The work cell of claim 15, wherein said processing region comprises a fastening table having:

a first head for applying a fastener to the container;

a second head for applying a fastener to the container;

a lower guide rail assembly; and an upper guide rail assembly;

wherein the orientation between said first head and said second head may be altered according to the size and type of the container used, said first head and said second head applying said fasteners to the container simultaneously; and wherein said lower guide rail assembly and said upper guide rail assembly aid in alignment of the container between said first head and said second head and may be positioned according to the size and type of the container to be sealed.

22. The work cell of claim 15, further comprising a mounting device for supporting materials for use in the operation of said work cell.

23. The work cell of claim 15, further comprising a label holder for supporting labels to be placed upon one or more of the containers.

24. The work cell of claim 15, further comprising a compartment for materials used in the operation of said work cell.

25. The work cell of claim 21, wherein said first head and said second head are aligned substantially vertically.

26. The work cell of claim 21, further comprising a first fastening device associated with said first head and a second fastening device associated with said second head, said first fastening device being positioned in an orientation opposite to an orientation of said second fastening device.

27. The work cell of claim 21, wherein said first head is proximate to said lower guide rail assembly and said second head is proximate to said upper guide rail assembly, said work cell operable to process said packaging container having an infinite length.

28. A work cell for packaging materials within a container comprising:

an inbound portion and toward an operating side of the work cell having:

a first inbound cradle including a first inbound surface and a second inbound surface abutting said first inbound surface and orientated at approximately a 90° angle to said first inbound surface; and a second inbound cradle including a third inbound surface and a fourth inbound surface abutting said third inbound surface and orientated at approximately a 90° angle to said third inbound surface;

an outbound portion and toward an operating side of the work cell having an outbound cradle including a first outbound surface and a second outbound surface abutting said first outbound surface and orientated at approximately a 90° angle to said first outbound surface;

a fastening device between said inbound and outbound portions having a first fastening head and a second fastening head, the orientation between the first fastening head and the second fastening head operable to be altered according the size and shape of the container;

wherein said first inbound cradle, said second inbound cradle, and said outbound cradle are each orientated to support the container such that the container is rotated toward the operating side of the work cell; and wherein said inbound portion and said outbound portion are positioned in at least a nearly abutting relationship, said inbound portion and said outbound portion being positioned at an obtuse angle relative to each other.

29. The work cell of claim 28, wherein said first inbound cradle is adjacent to said second inbound cradle.

30. The work cell of claim 28, wherein said outbound cradle is movable between a forward position and a rear position.

* * * * *